US011348484B2

(12) United States Patent
Wyatt

(10) Patent No.: US 11,348,484 B2
(45) Date of Patent: May 31, 2022

(54) DUAL RETRACTABLE BADGE AND KEY HOLDER APPARATUS

(71) Applicant: Patricia Wyatt, Midwest City, OK (US)

(72) Inventor: Patricia Wyatt, Midwest City, OK (US)

( * ) Notice: Subject to any disclaimer, the term of this patent is extended or adjusted under 35 U.S.C. 154(b) by 484 days.

(21) Appl. No.: 16/582,581

(22) Filed: Sep. 25, 2019

(65) Prior Publication Data

US 2021/0090472 A1 Mar. 25, 2021

(51) Int. Cl.
*B65H 75/48* (2006.01)
*G09F 3/20* (2006.01)
*A45F 5/00* (2006.01)

(52) U.S. Cl.
CPC ..... *G09F 3/207* (2013.01); *A45F 5/004* (2013.01); *B65H 75/48* (2013.01); *A45F 2200/055* (2013.01)

(58) Field of Classification Search
CPC ..... B65H 75/48; B65H 75/446; A45F 5/004; A45F 2200/055; G09F 3/207
See application file for complete search history.

(56) References Cited

U.S. PATENT DOCUMENTS 1,941,880 A * 1/1934 Earll ..... B65H 75/486 242/375
5,544,836 A * 8/1996 Pera ..... H04M 1/15 242/378.1
6,290,158 B1 * 9/2001 Huang ..... A45F 5/004 242/380
6,364,237 B1 4/2002 Kagel
6,840,414 B2 * 1/2005 Ziegler ..... A45F 5/004 248/579
7,007,882 B2 3/2006 Raia
7,007,892 B2 * 3/2006 Tubbs ..... B64C 1/18 244/119
7,574,881 B1 8/2009 Wong
7,774,969 B1 8/2010 Silverman
9,718,640 B2 8/2017 Burner
2004/0089759 A1 * 5/2004 Genuise ..... A45F 5/004 242/379
2007/0051842 A1 * 3/2007 Pryor ..... A45F 5/004 242/378.3
2008/0265082 A1 10/2008 Angiuli

* cited by examiner

*Primary Examiner* — Sang K Kim

(57) ABSTRACT

A dual retractable badge and key holder apparatus for conveniently securing keys and a badge includes a spool housing having an outer wall, an inner wall, and a sidewall. A median wall is coupled to the sidewall and lies parallel with the outer wall and the inner wall to define an outer cavity and an inner cavity. An axle is coupled to the spool housing. A pair of retractors comprises an outer retractor and an inner retractor coupled to the axle within the outer cavity and the inner cavity, respectively. Each retractor comprises a spool having a spring and a cord wound around the spool. A key ring is coupled to the inner retractor and is configured to secure a plurality of keys. A badge clip is coupled to the outer retractor and configured to secure a badge. A clamp is coupled to the axle adjacent the inner wall.

6 Claims, 4 Drawing Sheets

DUAL RETRACTABLE BADGE AND KEY HOLDER APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to key ring devices and more particularly pertains to a new key ring device for conveniently securing keys and a badge.

(2) Description of Related Art Including Information Disclosed Under 37 CFR 1.97 and 1.98

The prior art relates to key ring devices.

BRIEF SUMMARY OF THE INVENTION

An embodiment of the disclosure meets the needs presented above by generally comprising a spool housing having an outer wall, an inner wall, and a sidewall extending therebetween. A median wall is coupled to the sidewall and lies parallel with the outer wall and the inner wall to define an outer cavity and an inner cavity. The sidewall has an outer aperture extending through to the outer cavity and an inner aperture extending through to the inner cavity. An axle is coupled to the spool housing. The axle is coupled to the outer wall and extends through the median wall and the inner wall. A pair of retractors is coupled to the axle. The pair of retractors comprises an outer retractor and an inner retractor coupled within the outer cavity and the inner cavity, respectively. Each retractor comprises a spool pivotably coupled to the axle. The spool has a spring. A cord is windingly coupled around the spool and has a distal end extending through the outer aperture or the inner aperture, respectively. A stopper is coupled to the distal end. An attachment ring is coupled to the stopper. A key ring is coupled to the attachment ring of the inner retractor and is configured to secure a plurality of keys. A badge clip is coupled to the attachment ring of the outer retractor and is configured to secure a badge. A clamp is rotatably coupled to the axle adjacent the inner wall.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
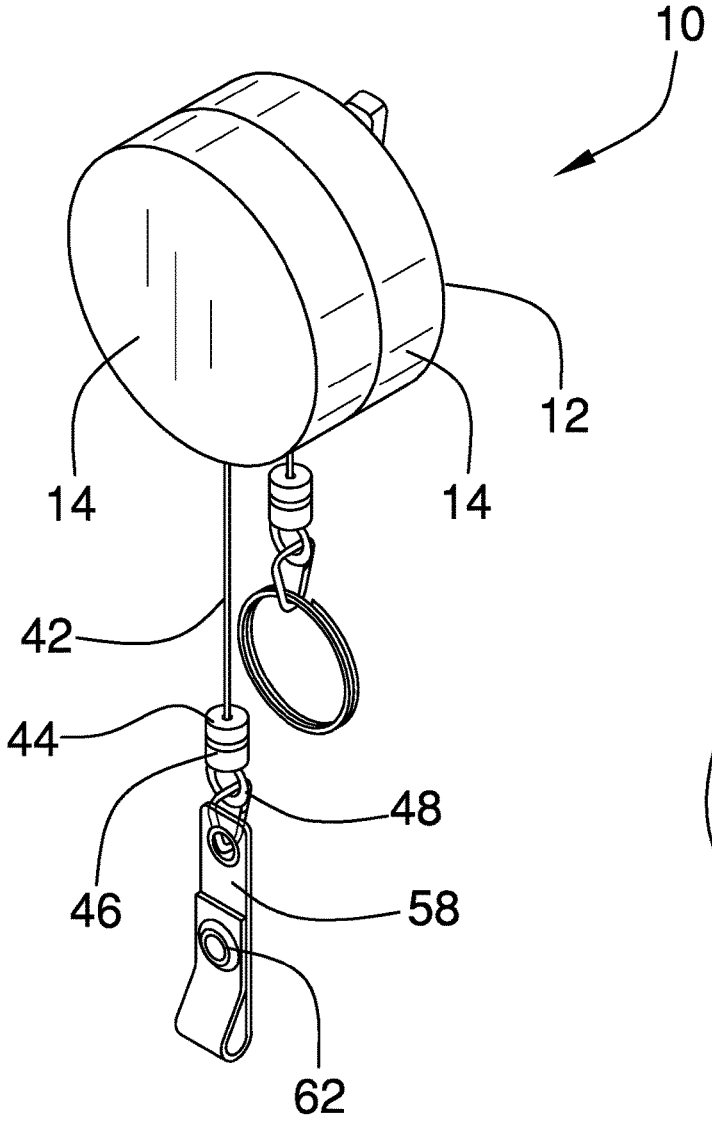
FIG. 1 is an isometric view of a dual retractable badge and key holder apparatus according to an embodiment of the disclosure.
Figure 2:
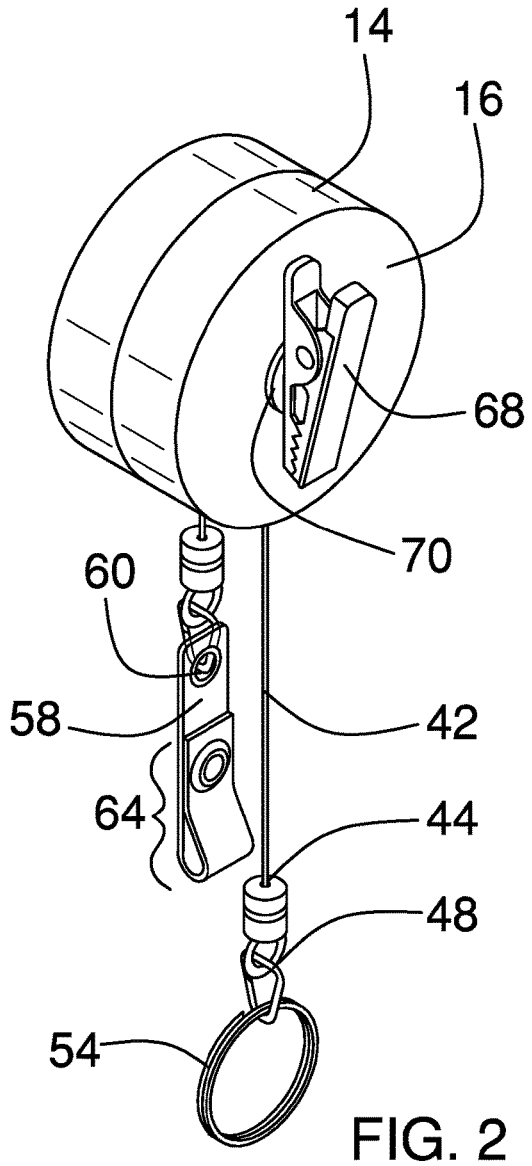
FIG. 2 is an isometric view of an embodiment of the disclosure.
Figure 3:
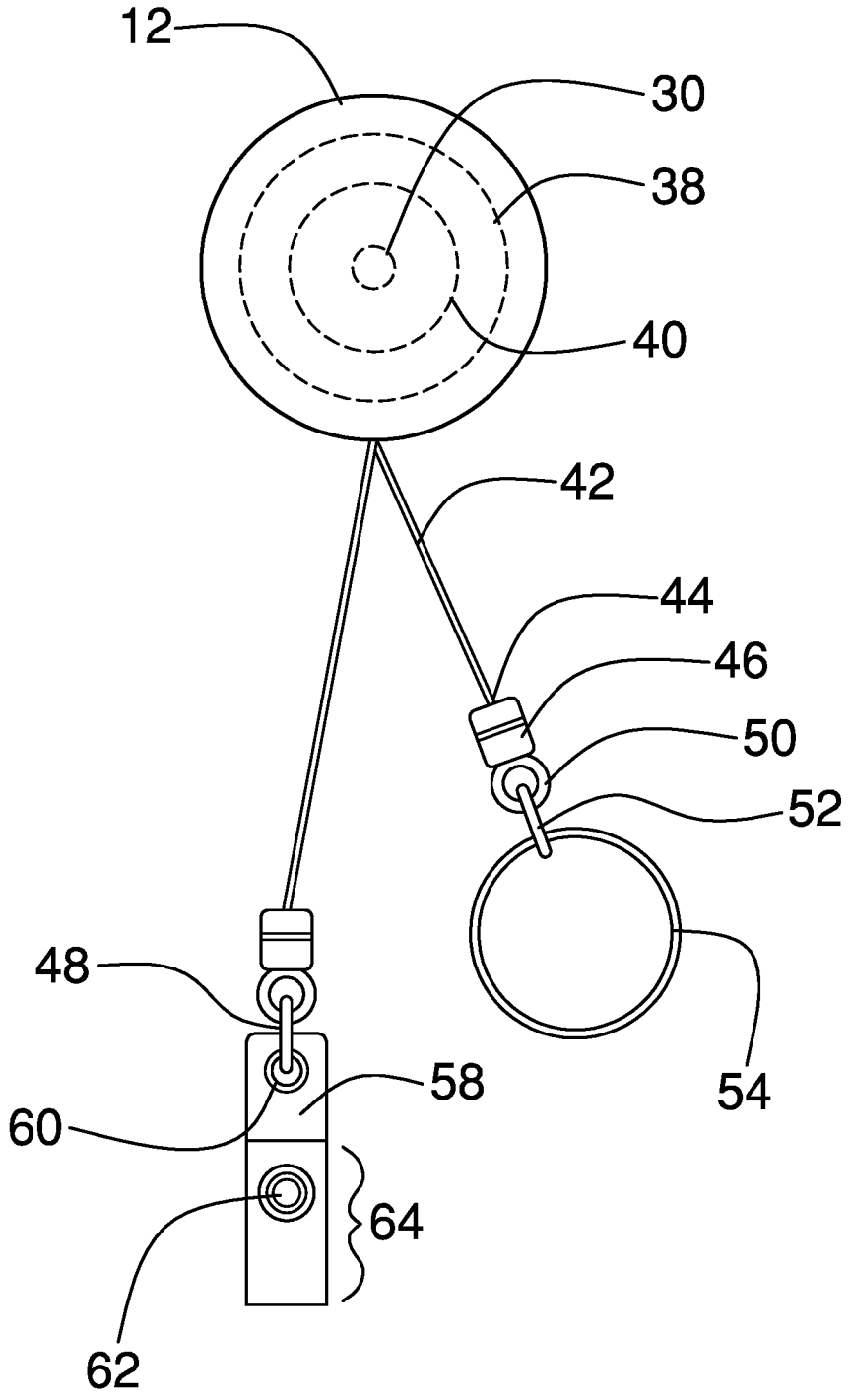
FIG. 3 is a front elevation view of an embodiment of the disclosure.
Figure 4:
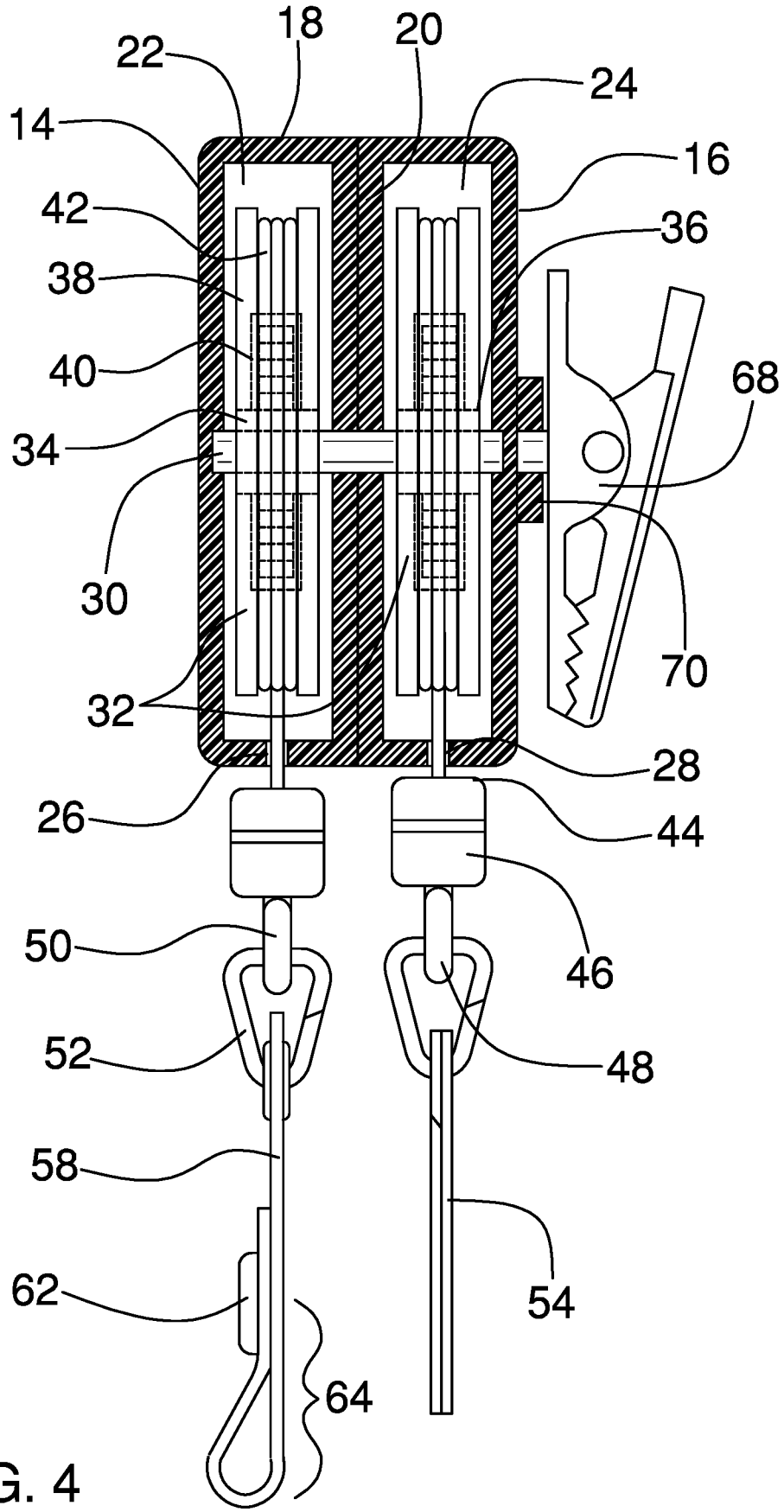
FIG. 4 is a cross-sectional view of an embodiment of the disclosure.
Figure 5:
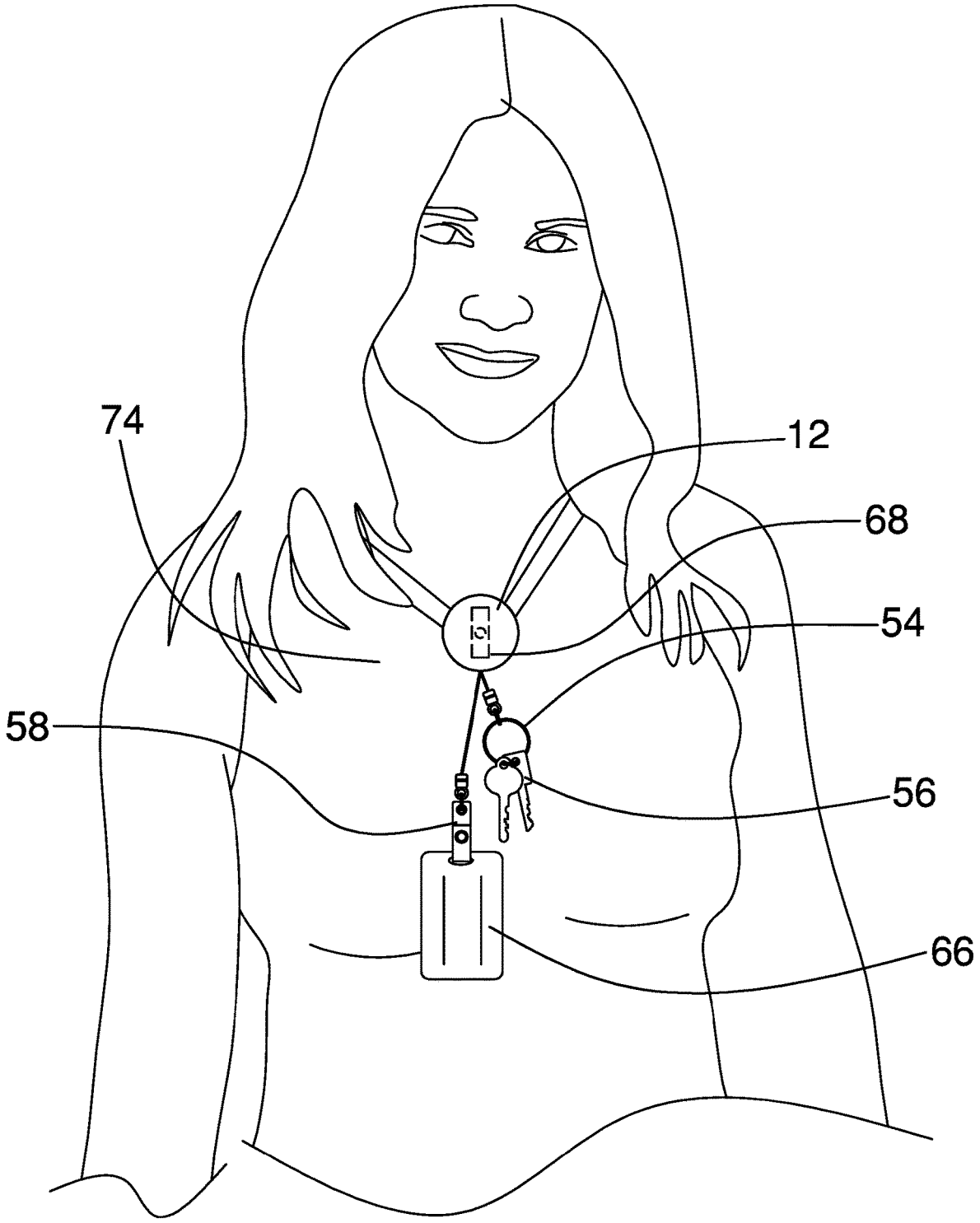
FIG. 5 is an in-use view of an embodiment of the disclosure.

With reference now to the drawings, and in particular to FIGS. 1 through 5 thereof, a new key ring device embodying the principles and concepts of an embodiment of the disclosure and generally designated by the reference numeral 10 will be described.

As best illustrated in FIGS. 1 through 5, the dual retractable badge and key holder apparatus 10 generally comprises a spool housing 12 having an outer wall 14, an inner wall 16, and a sidewall 18 extending therebetween. A median wall 20 is coupled to the sidewall 18 and lies parallel with the outer wall 14 and the inner wall 16 to define an outer cavity 22 and an inner cavity 24. The sidewall 18 has an outer aperture 26 extending through to the outer cavity 22 and an inner aperture 28 extending through to the inner cavity 24. An axle 30 is coupled to the spool housing 12. The axle 30 is coupled to the outer wall 14 and extends through the median wall 20 and the inner wall 16.

A pair of retractors 32 is coupled to the axle 30. The pair of retractors 32 comprises an outer retractor 34 and an inner retractor 36 coupled within the outer cavity 22 and the inner cavity 24, respectively. Each retractor 32 comprises a spool 38 pivotably coupled to the axle 30. The axle 30 has a spring 40 to rotate the spool 38 around the axle 30. A cord 42 is windingly coupled around the spool 38 and has a distal end 44 extending through the outer aperture 26 or the inner aperture 28, respectively. A stopper 46 is coupled to the distal end 44 of the cord to prevent the distal end 44 from retracting into the respective outer cavity 22 or inner cavity 24. The stopper 46 may be cylindrical. An attachment ring 48 is coupled to the stopper 46. The attachment ring 48 may comprise a circular eyelet 50 coupled to the stopper 46 and a triangular joining ring 52 coupled to the eyelet 50.

A key ring 54 is coupled to the inner retractor 36. The key ring 54 is coupled to the triangular joining ring 52 and is configured to secure a plurality of keys 56. A badge clip 58 is coupled to the outer retractor 34. The badge clip 58 has an attachment aperture 60 coupled to the triangular joining ring 52 and a snap 62 to selectively form a looped portion 64. The looped portion 64 is configured to attach to a badge 66. A clamp 68 is rotatably coupled to the axle 30 adjacent the inner wall 16. A spacer 70 may be coupled to the axle 30 between the inner wall 16 and the clamp 68 to allow the clamp 68 to rotate freely relative the spool housing 12. The clamp 68 may have a toothed portion 72 configured to secure the apparatus 10 to an article of clothing 74.

In use, the clamp 68 is secured to an article of clothing 74. The keys 56 or the bade 66 may be extended away from the apparatus 10 for use and then released allowing the spring 40 to rotate the spool 38 to retract the cord 42 until the stopper 46 contacts the spool housing 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A dual retractable badge and key holder apparatus comprising:

a spool housing, the spool housing having an outer wall, an inner wall, and a sidewall extending therebetween, a median wall being coupled to the sidewall, the median wall lying parallel with the outer wall and the inner wall and defining an outer cavity and an inner cavity, the sidewall having an outer aperture extending through to the outer cavity and an inner aperture extending through to the inner cavity;

an axle coupled to the spool housing, the axle being coupled to the outer wall and extending through the median wall and the inner wall;

a pair of retractors coupled to the axle, the pair of retractors comprising an outer retractor and an inner retractor coupled within the outer cavity and the inner cavity, respectively, each retractor comprising:

a spool, the spool being pivotably coupled to the axle and having a spring;

a cord coupled to the spool, the cord being windingly coupled around the spool and having a distal end extending through the outer aperture or the inner aperture, respectively;

a stopper coupled to the cord, the stopper being coupled to the distal end; and an attachment ring coupled to the stopper;

a key ring coupled to the inner retractor, the key ring being coupled to the attachment ring and being configured to secure a plurality of keys;

a badge clip coupled to the outer retractor, the badge clip being configured to secure a badge; and a clamp coupled to the axle, the clamp being rotatably coupled adjacent the inner wall.

2. The dual retractable badge and key holder apparatus of claim 1 further comprising a spacer coupled to the axle, the spacer being coupled between the inner wall and the clamp.

3. The dual retractable badge and key holder apparatus of claim 1 further comprising the attachment ring comprising a circular eyelet coupled to the stopper and a triangular joining ring coupled to the eyelet.

4. The dual retractable badge and key holder apparatus of claim 1 further comprising the stopper being cylindrical.

5. The dual retractable badge and key holder apparatus of claim 1 further comprising the badge clip having an attachment aperture and a snap to selectively form a looped portion, the looped portion being configured to attach to a badge.

6. A dual retractable badge and key holder apparatus comprising:

a spool housing, the spool housing having an outer wall, an inner wall, and a sidewall extending therebetween, a median wall being coupled to the sidewall, the median wall lying parallel with the outer wall and the inner wall and defining an outer cavity and an inner cavity, the sidewall having an outer aperture extending through to the outer cavity and an inner aperture extending through to the inner cavity;

an axle coupled to the spool housing, the axle being coupled to the outer wall and extending through the median wall and the inner wall;

a pair of retractors coupled to the axle, the pair of retractors comprising an outer retractor and an inner retractor coupled within the outer cavity and the inner cavity, respectively, each retractor comprising:

a spool, the spool being pivotably coupled to the axle and having a spring;

a cord coupled to the spool, the cord being windingly coupled around the spool and having a distal end extending through the outer aperture or the inner aperture, respectively;

a stopper coupled to the cord, the stopper being coupled to the distal end, the stopper being cylindrical; and an attachment ring coupled to the stopper, the attachment ring comprising a circular eyelet coupled to the stopper and a triangular joining ring coupled to the eyelet;

a key ring coupled to the inner retractor, the key ring being coupled to the attachment ring and being configured to secure a plurality of keys;

a badge clip coupled to the outer retractor, the badge clip having an attachment aperture and a snap to selectively form a looped portion, the looped portion being configured to attach to a badge;

a clamp coupled to the axle, the clamp being rotatably coupled adjacent the inner wall; and a spacer coupled to the axle, the spacer being coupled between the inner wall and the clamp.

* * * * *